US007832729B2

(12) United States Patent
Park

(10) Patent No.: US 7,832,729 B2
(45) Date of Patent: Nov. 16, 2010

(54) ORBITRACE—RACING GAME

(76) Inventor: Alexander C Park, 2905 Gambel La., Plano, TX (US) 75025

( * ) Notice: Subject to any disclaimer, the term of this patent is extended or adjusted under 35 U.S.C. 154(b) by 1042 days.

(21) Appl. No.: 11/466,103

(22) Filed: Aug. 21, 2006

(65) Prior Publication Data

US 2008/0042361 A1 Feb. 21, 2008

(51) Int. Cl.
*A63F 3/00* (2006.01)

(52) U.S. Cl. ..... 273/241; 273/260; 273/445; 434/128; 434/276; 434/277; 434/278

(58) Field of Classification Search ..... 273/445, 273/260, 241; 434/128, 276–278
See application file for complete search history.

(56) References Cited

U.S. PATENT DOCUMENTS 2,282,871 A * 5/1942 Malbon ..... 273/282.2
2,801,107 A * 7/1957 Green, Jr. ..... 273/241
3,464,701 A * 9/1969 Mahoney ..... 273/241
3,606,333 A * 9/1971 Green ..... 273/239
3,614,104 A * 10/1971 Gregory ..... 273/241
3,623,729 A * 11/1971 Wetherell ..... 273/241
3,656,755 A * 4/1972 Thompson ..... 273/241
3,684,285 A * 8/1972 Kane ..... 273/241
3,791,649 A * 2/1974 Gold ..... 273/239
3,871,656 A * 3/1975 Selness ..... 273/258
3,879,040 A * 4/1975 Smith ..... 273/241
4,019,743 A * 4/1977 Castanis ..... 273/241
4,082,283 A * 4/1978 La Ferla et al. ..... 273/241
4,099,723 A * 7/1978 Robinson ..... 273/241
4,129,303 A * 12/1978 Flagg ..... 273/241
4,182,516 A * 1/1980 Gill ..... 273/258
4,225,137 A * 9/1980 Hebner ..... 273/241
4,348,027 A * 9/1982 Escamilla-Kelly ..... 273/241
4,440,395 A * 4/1984 Hyland et al. ..... 273/241
4,535,993 A * 8/1985 Topits ..... 273/241
5,033,751 A * 7/1991 Ching ..... 273/241
5,108,108 A * 4/1992 Norman et al. ..... 273/241
5,193,813 A * 3/1993 Goff ..... 273/241
5,316,307 A * 5/1994 Kersh ..... 273/241
5,409,234 A * 4/1995 Bechter ..... 273/241
5,613,681 A * 3/1997 Allen ..... 273/271
5,660,388 A * 8/1997 Benn ..... 273/241
5,662,329 A * 9/1997 Nason ..... 273/261
5,702,105 A * 12/1997 Glikmann ..... 273/272
5,860,651 A * 1/1999 Fierro ..... 273/241
6,382,627 B1 * 5/2002 Lundberg ..... 273/285
6,394,452 B1 * 5/2002 Dunne ..... 273/241
6,419,228 B1 * 7/2002 Egli et al. ..... 273/236
6,533,277 B1 * 3/2003 Yin ..... 273/153 R
6,581,933 B1 * 6/2003 Zivan ..... 273/241
6,871,854 B2 * 3/2005 Lin ..... 273/258
6,883,803 B1 * 4/2005 Barry ..... 273/254

(Continued)

*Primary Examiner*—Gene Kim
*Assistant Examiner*—Alexander R Niconovich

(57) ABSTRACT

The open frame form of the polyhedron-shaped game structures are disclosed for playing a three-dimensional racing game. A variety of spacers and polyhedron shapes are introduced to configure the shape of the present invention. The preferred embodiment of the game structure is constructed with cubic frame and orbital routes. Each player has single set of game pieces and advances each game piece on the game structure according to the number shown on the die. The players are challenged to race and capture the opponent's game pieces according to their strategic plan. After orbiting the game structure, the first player who races back all of his or her game pieces to the predetermined finish point becomes the winner.

3 Claims, 7 Drawing Sheets

U.S. PATENT DOCUMENTS

| | | | | |
|---|---|---|---|---|
| 7,044,465 | B2 * | 5/2006 | Liu | 273/241 |
| 7,114,720 | B1 * | 10/2006 | Whitehurst | 273/241 |
| 7,114,723 | B2 * | 10/2006 | Park | 273/258 |
| 7,255,624 | B2 * | 8/2007 | Daftari | 446/92 |
| 7,273,404 | B2 * | 9/2007 | Kowalski et al. | 446/92 |
| 7,322,873 | B2 * | 1/2008 | Rosen et al. | 446/91 |
| 2004/0108655 | A1 * | 6/2004 | Liu | 273/241 |
| 2004/0135314 | A1 * | 7/2004 | Peterson | 273/241 |
| 2005/0029736 | A1 * | 2/2005 | Liu | 273/242 |
| 2005/0164758 | A1 * | 7/2005 | Boeru | 463/9 |
| 2005/0285339 | A1 * | 12/2005 | Park | 273/260 |
| 2006/0022404 | A1 * | 2/2006 | Imai | 273/236 |
| 2006/0119040 | A1 * | 6/2006 | Daniela | 273/241 |
| 2006/0175754 | A1 * | 8/2006 | Eggers | 273/260 |
| 2006/0220314 | A1 * | 10/2006 | Chung | 273/241 |
| 2007/0296149 | A1 * | 12/2007 | Hughes | 273/260 |
| 2008/0197567 | A1 * | 8/2008 | Ortubai Balanzategui | 273/241 |
| 2010/0148440 | A1 * | 6/2010 | Hart | 273/241 |

* cited by examiner

ORBITRACE—RACING GAME

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

BACKGROUND OF THE INVENTION

1. Field of the Invention

The present invention relates to the game apparatus, and more particularly to the game apparatus with attachable game pieces played on the outer surfaces of the three-dimensional game structure.

2. Description of Related Art

Various board-type racing games have been developed in the past. U.S. Pat. No. 6,883,803 B1 issued to Barry on Apr. 26, 2005 discloses a two-dimensional tourist game board. U.S. Pat. No. 4,182,516 issued to Gill on Jan. 8, 1980 discloses a two-dimensional sailboat racing game. U.S. Pat. No. 3,871,656 issued to Selness on Mar. 18, 1975 discloses a two-dimensional sailing game apparatus. These games are two-dimensional planer games and did not suggest three-dimensional movement for game pieces on the three-dimensional game structure. The present invention is to produce a game in which the player can be challenged to race and capture the opponent's game piece on the transformable three-dimensional game structure.

The three-dimensional game apparatus which incorporate the concept of tic-tac-toe or checker type of games have been developed in the prior art wherein a series of two-dimensional playing surfaces are vertically arranged one above the other. So that game piece can be moved or arranged on a two-dimensional playing surface as well as between the playing surfaces. One such game apparatus is disclosed by Mahoney U.S. Pat. No. 3,464,701 on Sep. 2, 1969, wherein a series of horizontally disposed playing boards are vertically supported in parallel spaced relationship by a box-shaped frame.

U.S. Pat. No. 3,623,729 issued to Wetherell on Nov. 30, 1971 discloses a three-dimensional board game apparatus. U.S. Pat. No. 3,656,755 issued to Thompson on Apr. 18, 1972 discloses a three-dimensional checker game apparatus. U.S. Pat. No. 4,129,303 issued to Flagg on Dec. 12, 1978 discloses a cubic game board. Another three-dimensional game apparatus of the tic-tac-toe type is constructed with rods joined together to form a grid pattern in the shape of a cube. A three-dimensional tic-tac-toe game is played by arranging game pieces on selected horizontal runs of the grid pattern. A game apparatus of this type is disclosed by Green in U.S. Pat. No. 3,606,333 on Sep. 20, 1971.

Even though the prior art's innovations may be suitable for the specific individual purposes to which they address, they would not be comparable for the purposes of the present invention as heretofore described.

BRIEF SUMMARY OF THE INVENTION

The problem of the prior art three-dimensional games is that they attempt to extend two-dimensional game piece movement into three dimensions where the actual three-dimensional game structure does not exist. They are still very much like planar games with separated multiple level that game pieces can move between the tiers. A polyhedron-shaped game structure is introduced to overcome the problems of the prior arts. A variety of spacers and polyhedron shapes are used to configure the 'open frame form' of the present invention. The three-dimensional game structure of the present invention can be easily transformable from one shape to another (i.e., shapes of cube, cylinder, octahedron and sphere, etc.). By following the edges of the 'open frame form' of the game structure, the game pieces can move in the vertical routes the same way that they can in the horizontal routes. These aspects are what makes the game fully three-dimensional, rather than just a planar game on multiple levels.

The primary objective of the present invention is to provide the game apparatus comprising a three-dimensional game structure and game pieces can be played in three-dimensional manner. Another objective of the present invention is to produce a game in which the player can provide a game of skill having numerous variations and degrees of complexity of strategy limited only by the imagination and innovativeness of the players in devising the rules of play.

Before explaining preferred embodiment of the invention in detail, it is to be understood that the invention is not limited in its application to the details of construction and to the arrangements of the components set forth in the following description or illustrated in the drawings.

BRIEF DESCRIPTION OF THE SEVERAL VIEWS OF THE DRAWINGS

The present invention will be more fully understood by studying the following description taken in connection with the accompanying drawings, wherein.

Figure 1:
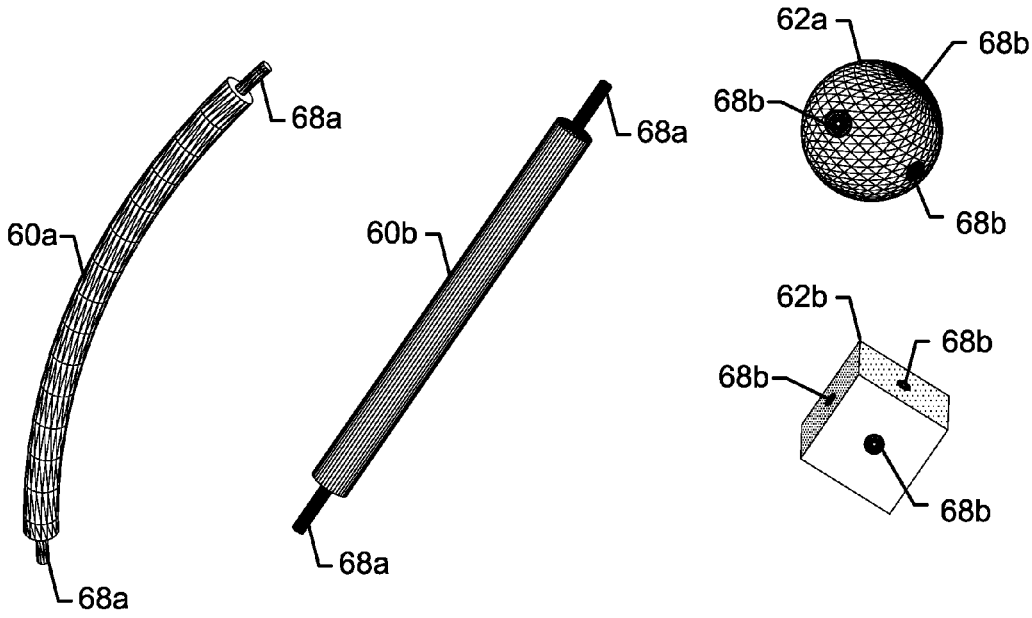
FIG. 1 shows the game structure components.

| List of Reference Numerals Utilized in Drawings | |
|---|---|
| 10 - Cube-Shaped Game Structure | |
| 20 - Cylinder-Shaped Game Structure | |
| 30 - Octahedron-Shaped Game Structure | |
| 40 - Sphere-Shaped Game Structure | |
| 50 - Prototype of Present Invention | |
| 60a - Curved Spacer | 60b - Straight Spacer |
| 62a - Sphere Game Space | 62b - Cube Game Space |
| 64a - Red Game Piece | 64b - Blue Game Piece |
| 66a - Red Crown | 66b - Blue Crown |
| 68a - Protrusion | 68b - Aperture |
| 70a - Origin Point Game Space | 70b - Turning Point Game Space |
| 70c - Center Point Game Space | 70d - Vertex Point Game Space |

DETAILED DESCRIPTION OF THE INVENTION

The present invention is for the game of two or more players divided into the teams and racing their game pieces on the game structure. The present invention can be played either on the physical configuration version or on the electronic simulation version. The physical configuration version of the present invention is shown in FIG. 1 through FIG. 13. A prototype screenshot of the electronic simulation version is shown in FIG. 14. It is to be understood that it is within the scope of the present invention also to provide corresponding electronic implements thereof for use on programmable digital computers and other microprocessor-based electronic devices. The present invention can be played on electronic simulated systems which include systems like console games, personal computer games and Internet on-line games, etc.

The game structure components for the present invention are shown in FIG. 1. Curved Spacer 60*a* and Straight Spacer 60*b* are interconnected with Sphere Game Space 62*a* and Cube Game Space 62*b* to form a variety of the game structure shapes as illustrated in FIG. 3 through FIG. 14. Protrusion 68*a* of Curved Spacer 60*a* and Straight Spacer 60*b* fits into Aperture 68*b* of Sphere Game Space 62*a* and Cube Game Space 62*b* for a snug fit. Another way to construct the present invention is that a predetermined number of holes are drilled through the game spaces (62*a* and 62*b*) and then they are threaded with a predetermined shape of spacers (60*a* or 60*b*). The game spaces and the spacers can be made by injection molding process. The number of game spaces can be varied depending upon the number or sets of game pieces and the rules governing play.

Figure 2:
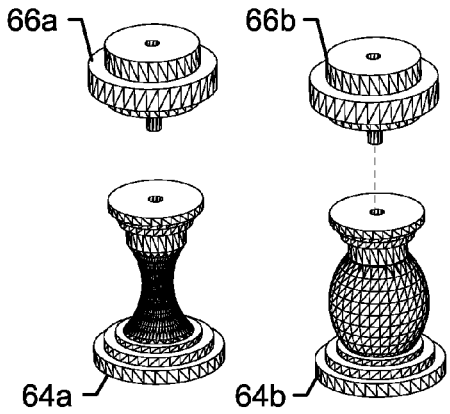
FIG. 2 shows the perspective view of the game pieces.

The game piece for the present invention Red Game Piece 64*a* and Blue Game Piece 64*b* are shown in FIG. 2. The game pieces can take many different configurations, therefore game pieces shown in the present invention are purely arbitrary and various other shapes may be assigned to these game pieces to stimulate interest and variety in the game. The game pieces are divided into at least two visually distinct sets so that the players are able to determine which game pieces are being used by a particular player. At the same time, contrasting coloration is applied for quick and easy identification. The present invention can be played by two, three or four players simultaneously depending upon the number of sets of game pieces and the rules governing play.

The polyhedron-shaped game spaces (62*a* and 62*b*) and the game pieces (64*a* and 64*b*) include mutually cooperative means of conventional type for retaining the game pieces in place within the game spaces. For example, the game spaces may be formed of a ferromagnetic material (i.e. steel) and each game piece may incorporate a magnet material to enable the game pieces (64*a* and 64*b*) to be securely retained when placed on the surfaces of game spaces (62*a* and 62*b*). In the case of a plastic or nonferrous game space, each game space may be formed with a hole or recess for receiving a projection on the underside of each game piece.

Furthermore, it is to be understood that any other suitable method for retaining game pieces onto the outer surfaces of game space, such as by the use of 'hook and loop fastener' or suction cups can be substituted for the magnets or pegs snuggly fitting within holes in the game space described above. Other well known attachment or fastening means may also be employed and are considered to fall within the scope of the invention. The polyhedron-shaped game spaces (62*a* and 62*b*) are preferably constructed of magnetically permeable material to insure that the game pieces (64*a* and 64*b*) are held stationary when placed in a particular area of the game space.

Figure 3:
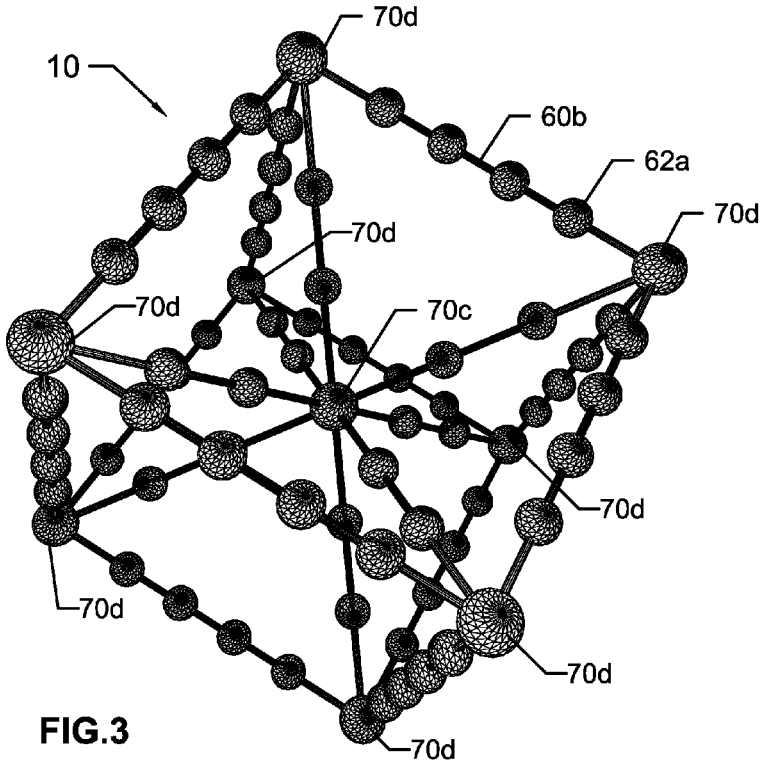
FIG. 3 shows the cube-shaped game structure.
Figure 3A:
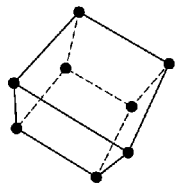
FIG. 3A illustrates the eight vertices of the cube.
Figure 3B:
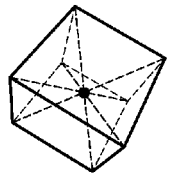
FIG. 3B illustrates the center of the cube.
Figure 4:
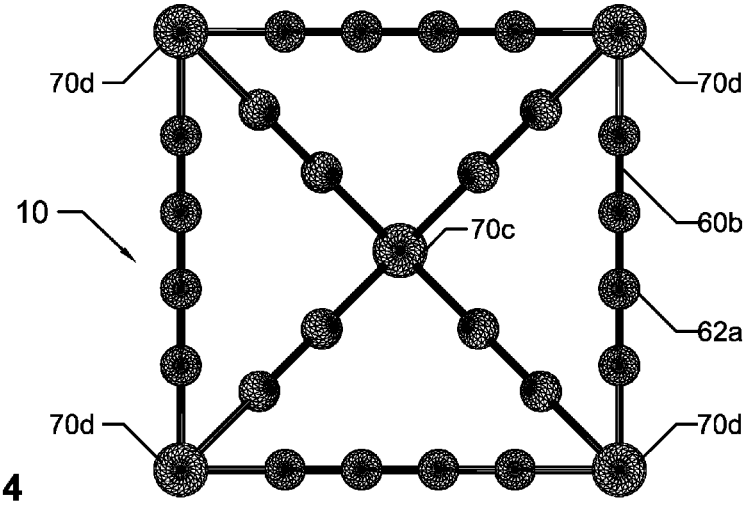
FIG. 4 is a top view of the cube-shaped game structure.
Figure 5:
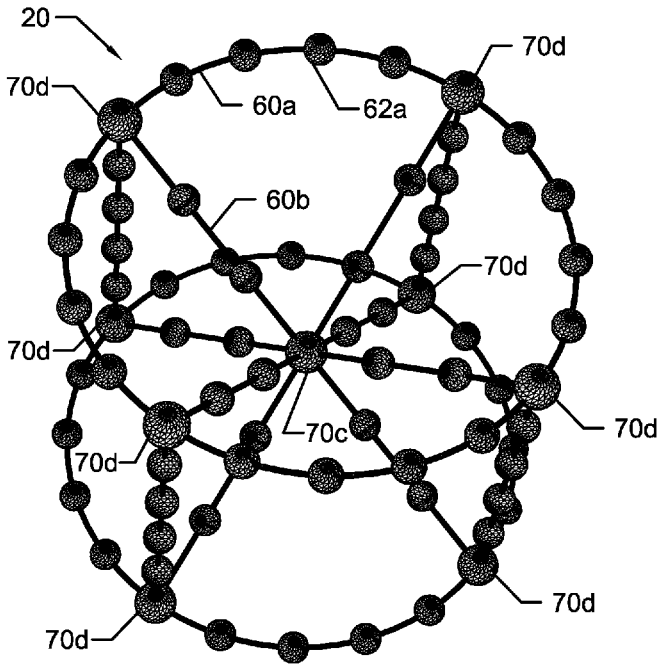
FIG. 5 shows the cylinder-shaped game structure.
Figure 5A:
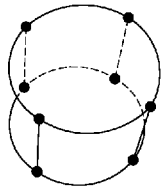
FIG. 5A illustrates the eight quadrant of the cylinder.
Figure 5B:
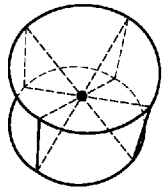
FIG. 5B illustrates the center of the cylinder.
Figure 6:
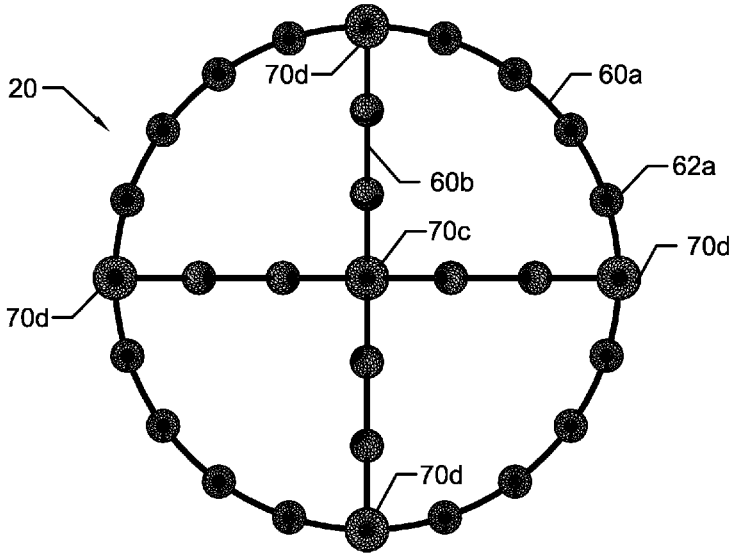
FIG. 6 is a top view of the cylinder-shaped game structure.

FIG. 3 illustrates the cube-shaped game structure of the present invention. FIG. 3A illustrates that the cube is composed of six square faces that meet each other at right angles and has eight vertices and twelve edges. The center of the cube is illustrated on FIG. 3B. Cube-Shaped Game Structure 10 is constructed based on this configuration. Each vertex and the center of the cube are replaced by Vertex Point Game Space 70*d* and Center Point Game Space 70*c*. It is to be realized that game spaces can be addressed with particular names depending on where there are located, even though they are constructed with same components. Twelve edges are constructed with Straight Spacer 60*b* and Sphere Game Space 62*a*. FIG. 5 illustrates that Cube-shaped Game Structure 10 can be transformed to Cylinder-Shaped Game Structure 20 by replacing some of the twelve edges with Curved Spacer 60*a*. FIG. 5A illustrates that Cylinder-Shaped Game Structure 20 is composed of eight quadrants and twelve edges. FIG. 5B illustrates the center of the Cylinder-Shaped Game Structure 20. FIG. 4 and FIG. 6 shows the top view of the each game structure. This illustrates that these two game structures are basically the same concept, but constructed by different configuration.

Figure 7:
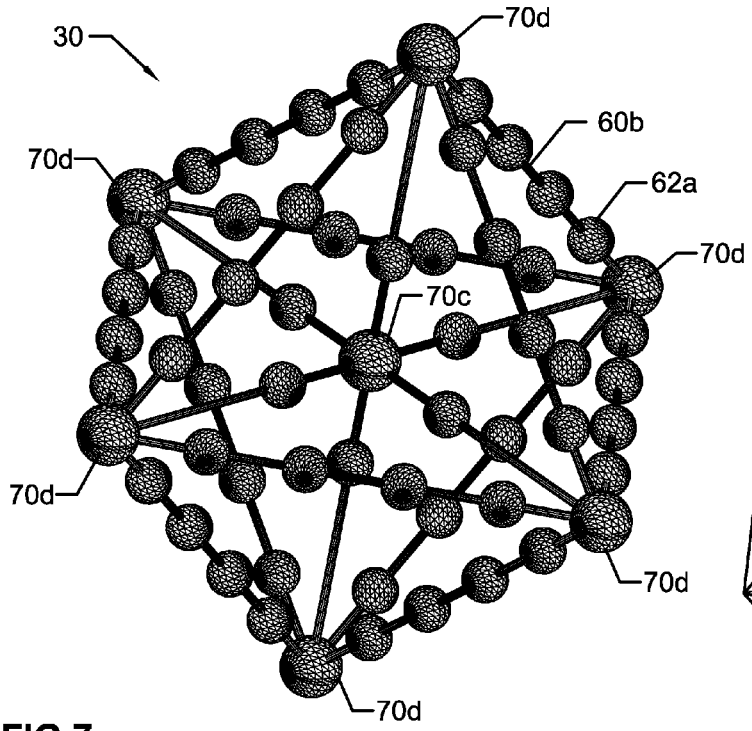
FIG. 7 shows the octahedron-shaped game structure.
Figure 7A:
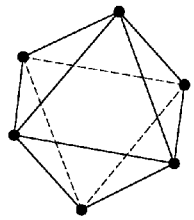
FIG. 7A illustrates the six vertices of the octahedron.
Figure 7B:
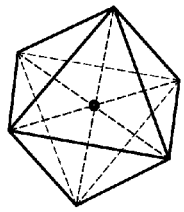
FIG. 7B illustrates the center of the octahedron.
Figure 8:
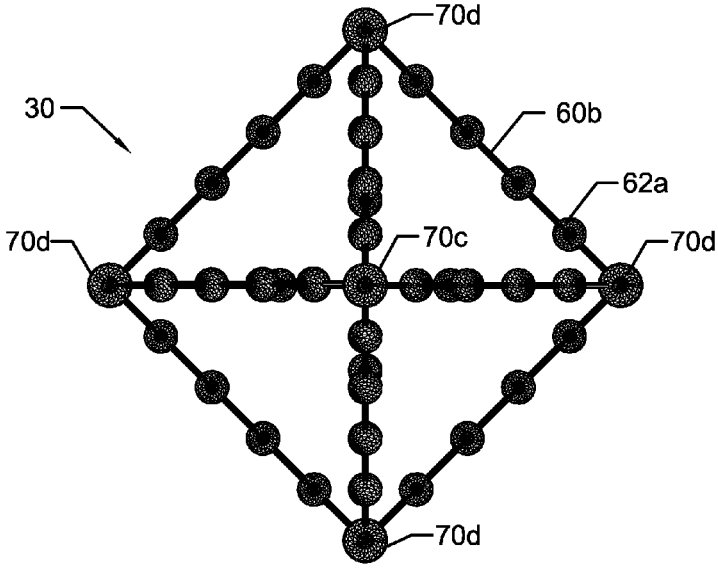
FIG. 8 is a top view of the octahedron-shaped game structure.
Figure 9:
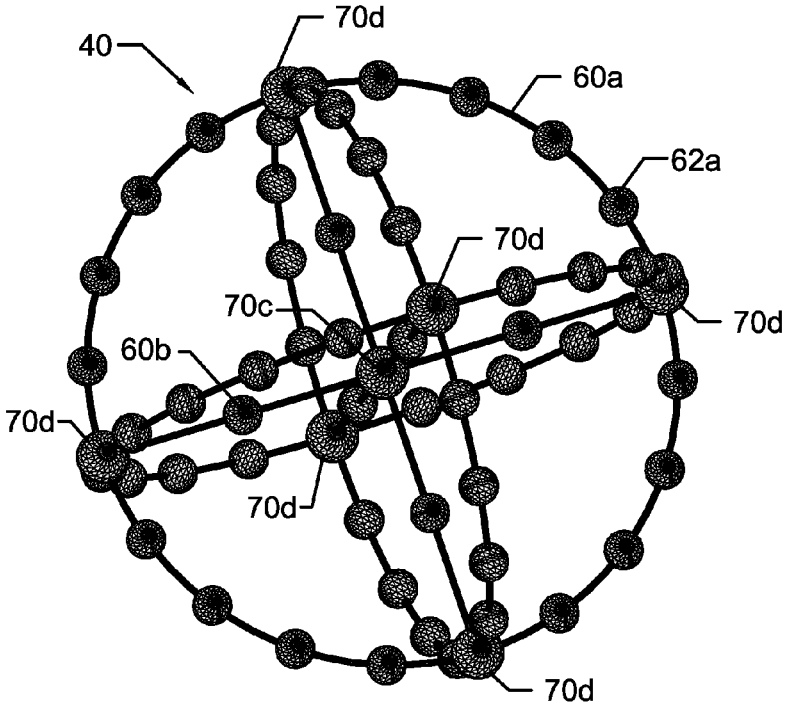
FIG. 9 shows the sphere-shaped game structure.
Figure 9A:
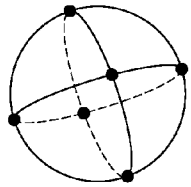
FIG. 9A illustrates the six quadrant of the sphere.
Figure 9B:
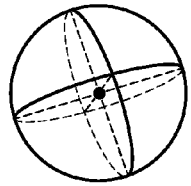
FIG. 9B illustrates the center of the sphere.
Figure 10:
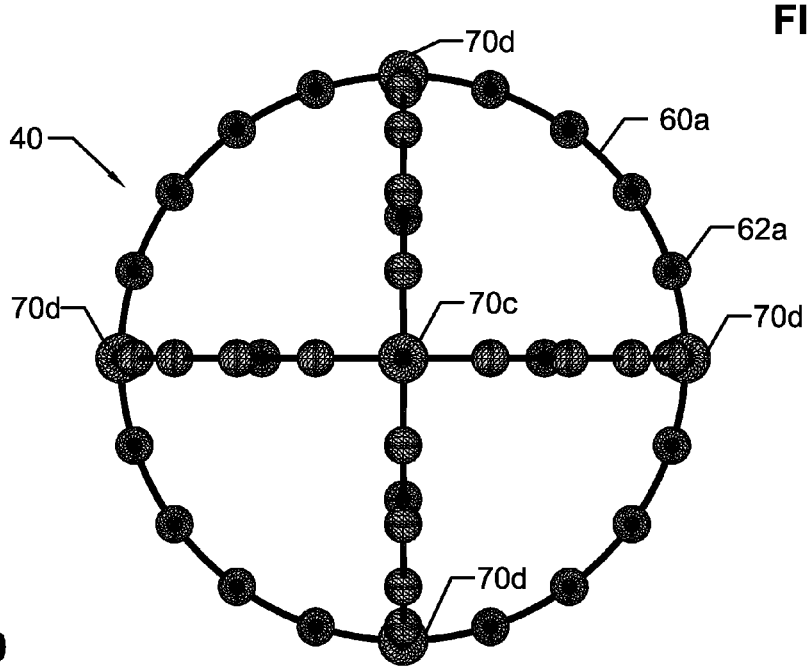
FIG. 10 is a top view of the sphere-shaped game structure.

FIG. 7 illustrates the octahedron-shaped game structure of the present invention. FIG. 7A illustrates that octahedron is composed of eight faces and has six vertices and twelve edges. The center of the octahedron is illustrate on FIG. 7B. Octahedron-Shaped Game Structure 30 is constructed based on this configuration. Each vertex and the center of the octahedron are replaced by Vertex Point Game Space 70*d* and Center Point Game Space 70*c*. It is to be realized that game spaces can be addressed with particular names depending on where there are located, even though they are constructed with same components. Twelve edges are constructed with Straight Spacer 60*b* and Sphere Game Space 62*a*. FIG. 9 illustrates that Octahedron-Shaped Game Structure 30 can be transformed to Sphere-Shaped Game Structure 40 by replacing the twelve edges with Curved Spacer 60*a*. FIG. 9A illustrates that Sphere-Shaped Game Structure 40 is composed of six quadrants and twelve curved edges. FIG. 9B illustrates the center of the Sphere-Shaped Game Structure 40. FIG. 8 and FIG. 10 shows the top view of the each game structure. This illustrates that these two game structures are basically the same concept, but constructed by different configuration.

Several embodiments of the game structure of the present invention are illustrated in FIG. 3 through FIG. 10. The preferred embodiment of game structure is adapted, for the sake of convenience. The preferred embodiment of the present invention is illustrated in FIG. 11 through FIG. 14. The game structure designated Prototype of Present Invention 50 is a skeletal 'open frame form' of the cubic game structure having eight vertices and twelve edges configuration. The preferred embodiment of game structure also includes a Center Point Game Space 70*c* which connected to each vertex location by a predetermined shape of the spacers. Each edge contains four game spaces and each axis connected to a Center Point Game Space 70*c* contains two game spaces.

Figure 11:
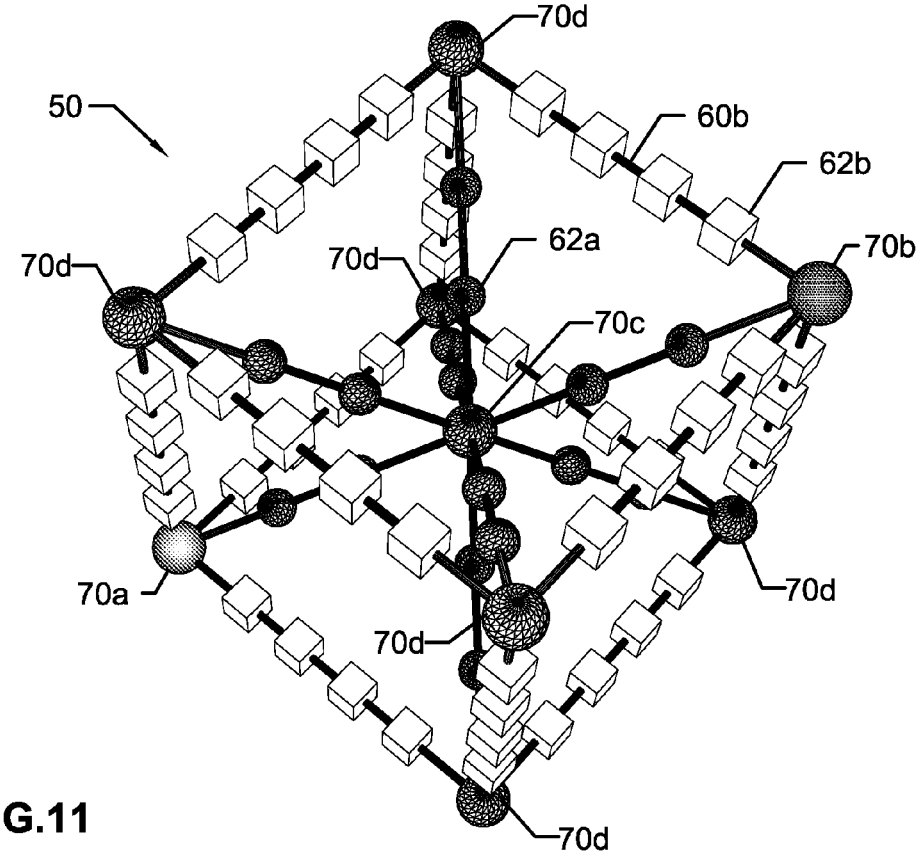
FIG. 11 shows the preferred embodiment of the present invention.
Figure 12:
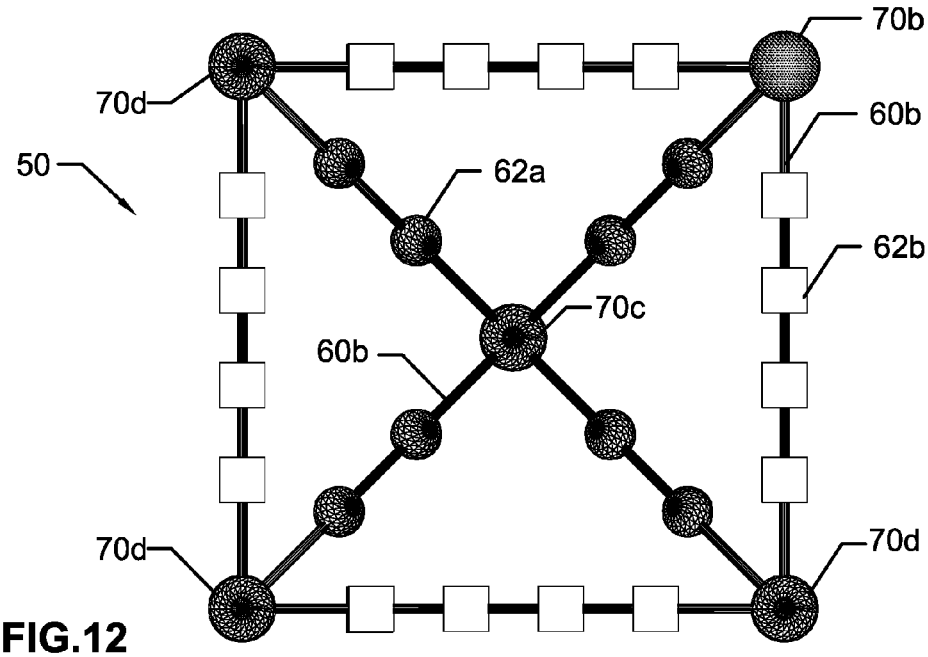
FIG. 12 is a top view of the preferred embodiment of the present invention.

FIG. 11 shows the same game structural configuration as shown in FIG. 3 and Sphere Game Space 62*a* on twelve edges have been replaced by Cube Game Space 62*b*. This shows that game spaces of the present invention can be replaced by any kind of polyhedron shapes, not limited to the particular polyhedron shapes as illustrated in the drawings. Two of the Vertex Point Game Space 70*d* is replaced by a Origin Point Game Space 70*a* and a Turning Point Game Space 70*b*. Again, it is to be realized that game spaces can be addressed with particular names depending on where there are located, even though they are constructed with same components. These two game spaces (70*a* and 70*b*) are directly connected by Center Point Game Space 70*c* axis. In other to define Origin Point Game Space 70*a* and Turning Point Game Space 70*b*, the contrasting coloration is used for these two game spaces (70*a* and 70*b*). For instance, Origin Point Game Space 70*a* could be red, Turning Point Game Space 70*b* could be blue, and the rest of the game spaces could be white. FIG. 12 shows the top view of the preferred embodiment of the present invention having the same structural configuration as shown in FIG. 4.

Figure 13:
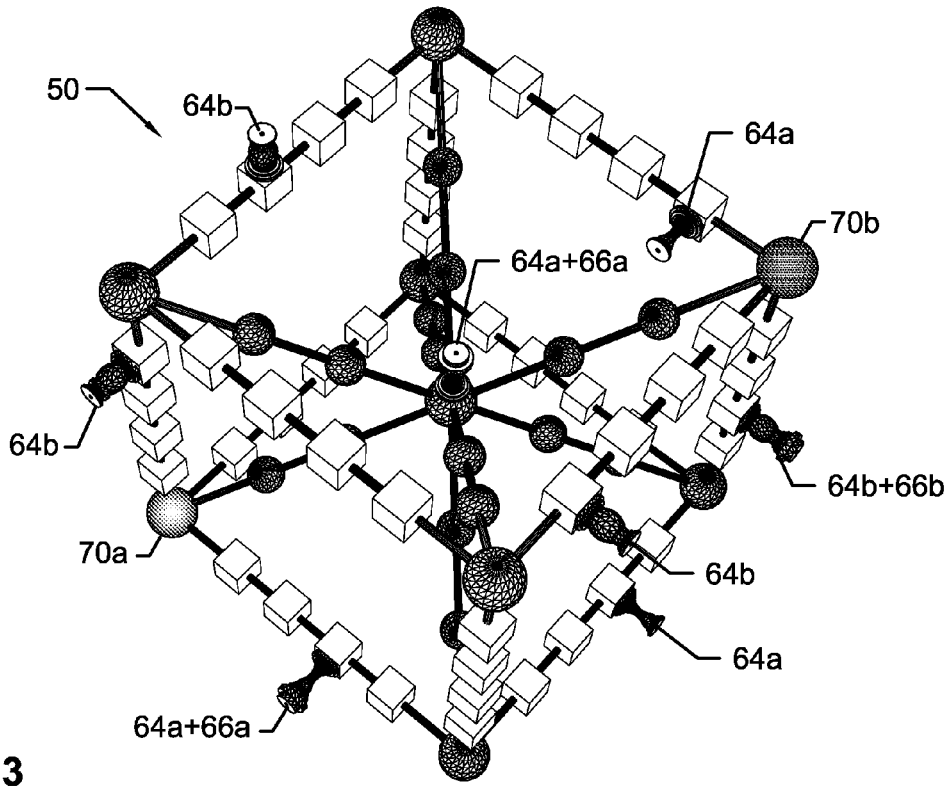
FIG. 13 shows a perspective view of the present invention game structure with game pieces.
Figure 14:
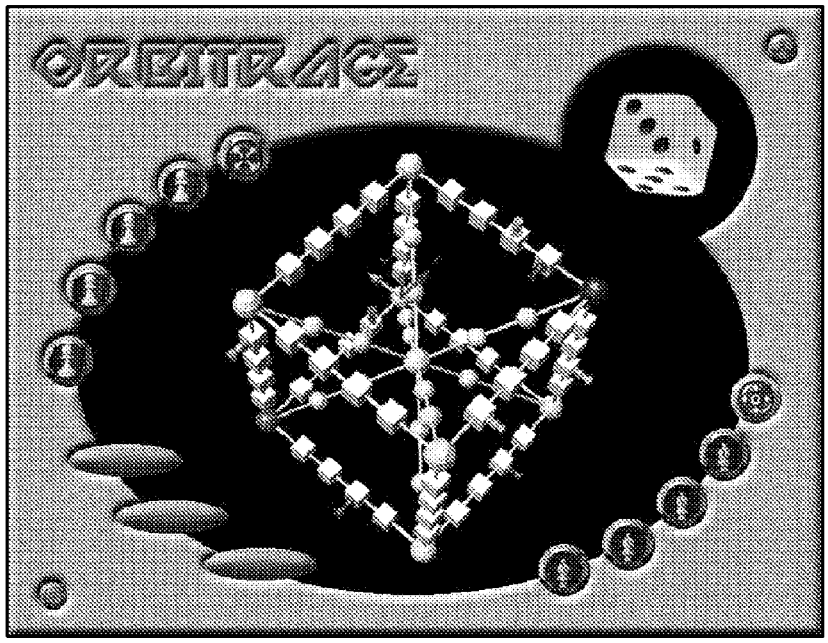
FIG. 14 illustrates the prototype of electronic simulation version of the present invention.

In a typical two players (or two teams) game is illustrated in FIG. 13. Each player or team has four game pieces as a single set. Different shape or different color represents each player or team. The object of the game is to race the game pieces on the orbital game structure. The players start their game at Origin Point Game Space 70*a* first, and then they race their game pieces on orbital routes on the game structure according to the number shown on a 'random number generator' device. After passing Turning Point Game Space 70*b*, the first player (or team) who races back all of his or her game pieces to Origin Point Game Space 70*a* becomes the winner.

To play the present invention, conventional six-sided die is used as a 'random number generator'. To begin play, each player rolls the six-sided die. The player or team with higher number starts first, and then each player must take a turn to roll the die. Each player picks game pieces to move and places them on Origin Point Game Space 70*a* one at a time. For their first turn, players are only allowed to move their game pieces to the edge direction on the game structure. On their turn, players roll the die and move their game pieces, game space by game space, according to the number shown on the die. For example, if the player rolls the face value of number three, the player moves his or her game piece to third game space on any edge or axis from the current position. When players reaches the first Vertex Point Game Space 70*d*, players can move their game pieces to any forwarding direction including moving diagonally to Center Point Game Space 70*c*.

If the player's game piece landed on the opponent's game piece, this is called 'Capturing'. Any captured game pieces should be removed from the game space and restart the race from the beginning. To make the game interesting, the player rolls the face value of number six will lose his or her turn. If the player rolls the face value of number five or captures the opponent's game pieces, the player gets extra turn to play. The game piece can also move backward to capture the opponent's game piece. Two or more game pieces of the player may be on the same game space at the same time, this is called 'Stacking' and double, triple, quadruple 'Stacking' is possible. The game pieces in 'Stacking' mode move together as a group. But there is a great risk that all of the stacked game pieces can be captured by the opponent's one single movement. All of the captured game pieces which were in 'Stacking' mode should be removed from the game space and restart the race all over again from the Origin Point Game Space 70*a*. 'Stacking' can be advantage or disadvantage. There is a chance to finish the race faster than opponent, but if the player's stacked game pieces were captured by opponent, it will increase the chance of losing the game.

When players reach the Turning Point Game Space 70*b*, the player's game piece will receive the crown (Red Crown 66*a* for Red Game Piece 64*a* and Blue Crown 66*b* for Blue Game Piece 64*b*) as shown in FIG. 2 and head for the Origin Point Game Space 70*a*. In this way, any game pieces which already passed the Turning Point Game Space 70*b* could be quickly and easily identified. The method for retaining crowns (66*a* and 66*b*) on game pieces (64*a* and 64*b*) is similar to the method previously mentioned on game piece attachments to the game space. 'Crowning' is just a mark and there are several ways to define the game piece which already passed the Turning Point Game Space 70*d*. This object can be achieved by changing the color or the shape of the game pieces.

After passing the Turning Point Game Space 70*b*, the first player who races all of his or her game pieces to the Origin Point Game Space 70*a* wins the game. The players can get there two ways; easy way and difficult way. Easy way is that players can reach the Origin Point Game Space 70*a* regardless of having exact count on the face value of the die. Difficult way is that all the game pieces must land on Origin Point Game Space 70*a* by exact count. If the player's roll would take the player past Origin Point Game Space 70*a*, player's game piece can not be moved or should be moved forward and backward until the player gets the exact count to finish the race. However, the player can move backward to capture the opponent's piece when attacked by an opponent's game piece. This goal can be achieved depending on how to set the rules in the beginning of the game.

It is apparent that the game pieces, the game space and the game structure can be formed in a variety of configurations other than the examples shown in this present invention. It is also to be realized that a great many variations are possible to the game structure and the game rules which are presented as alternate embodiments of the invention. One possible variation of the game structure is that additional polyhedron game spaces can be added or subtracted for more complex or simpler game. Additional game pieces can be added or reduced accordingly. Another possible variation is multiple game structures for multiple players. Several game structures can be added and joined together for the additional players. Other types of polyhedron shape can be introduced to configure the shape of the present invention. Instead of using conventional six-sided die, other types of the 'random number generator' (i.e., eight-sided die, spinner board, random electric counting device, and cards with numbers, etc.) can be used for playing the present invention. It should be understood that many of the preferred moves of the game pieces may be altered in some fashion, without departing from the spirit of the invention.

While the invention has been described and illustrated in detail, it is to be clearly understood that this is intended by way of illustration and example only and is not to be taken by way of limitation. Persons skilled in the art will readily see that a great many variations are possible within the spirit and scope of the present invention. Thus the scope of the invention should be determined by the appended claims and their legal equivalents, rather than by the examples given.

I claim:

1. A three-dimensional game apparatus, consisting of:

(a) a cubic game structure having eight vertices and twelve edges of three-dimensional geometrical configurations, said cubic game structure including;

(b) said eight vertices having polyhedrons as game spaces;

(c) the center of said cubic game structure having a central polyhedron as a game space;

(d) each of said twelve edges having a spacer of a predetermined shape and four polyhedrons on the spacer as game spaces;

(e) each said eight vertices having a polyhedron game spaces connected diagonally to said central polyhedron by a spacer of a predetermined shape and two polyhedrons on the spacer as game spaces; and the game apparatus further including (f) a predetermined number of game pieces individually identifiable;

(g) means for attaching each game piece to the exposed faces of said game spaces in said cubic game structure.

2. A three dimensional game apparatus for use with a plurality of attachable game pieces, consisting of:

(a) a hexahedron vertex point game structure having eight vertices and twelve edges of three-dimensional geometrical configurations, said hexahedron vertex point game structure including;

(b) said eight vertices having polyhedrons as game spaces;

(c) the center of said hexahedron vertex point game structure having a central polyhedron as a game space;

(d) each of said twelve edges having a spacer of a predetermined shape and a predetermined number of polyhedrons on the spacer as game spaces;

(e) each said eight vertices having a polyhedron game space connected diagonally to said central polyhedron by a spacer of a predetermined shape and a predetermined number of polyhedrons on the spacer as game spaces; and the game apparatus further including (f) a predetermined number of game pieces individually identifiable;

(g) means for attaching each game piece to the exposed faces of said game spaces in said hexahedron vertex point game structure.

3. A three dimensional game apparatus for use with a plurality of attachable game pieces,consisting of:

(a) an octahedron vertex point game structure having six vertices and twelve edges of three-dimensional geometrical configurations, said octahedron vertex point game structure including;

(b) said six vertices having polyhedrons as game spaces;

(c) the center of said octahedron vertex point game structure having a central polyhedron as a game space;

(d) each of said twelve edges having a spacer of a predetermined shape and a predetermined number of polyhedrons on the spacer as game spaces;

(e) each said six vertices having a polyhedron game space connected diagonally to said central polyhedron by a spacer of a predetermined shape and a predetermined number of polyhedrons on the spacer as game spaces; and the game apparatus further including (f) a predetermined number of game pieces individually identifiable;

(g) means for attaching each game piece to the exposed faces of said game spaces in said octahedron vertex point game structure.

* * * * *